US007661415B2

(12) United States Patent
Nakamura

(10) Patent No.: US 7,661,415 B2
(45) Date of Patent: Feb. 16, 2010

(54) EGR COOLER

(75) Inventor: Yoichi Nakamura, Nagoya (JP)

(73) Assignee: T.RAD Co., Ltd., Tokyo (JP)

( * ) Notice: Subject to any disclaimer, the term of this patent is extended or adjusted under 35 U.S.C. 154(b) by 17 days.

(21) Appl. No.: 11/664,082

(22) PCT Filed: Sep. 27, 2005

(86) PCT No.: PCT/JP2005/018258

§ 371 (c)(1),
(2), (4) Date: Mar. 27, 2007

(87) PCT Pub. No.: WO2006/035986

PCT Pub. Date: Jun. 4, 2006

(65) Prior Publication Data

US 2007/0289581 A1 Dec. 20, 2007

(30) Foreign Application Priority Data

Sep. 28, 2004 (JP) ..... 2004-281862
Feb. 17, 2005 (JP) ..... 2005-041178
Feb. 23, 2005 (JP) ..... 2005-047830

(51) Int. Cl.
*F02B 47/08* (2006.01)

(52) U.S. Cl. ..... 123/568.12; 123/119 A; 60/605.2

(58) Field of Classification Search ..... 123/119 A, 123/568.11, 568.12; 60/272, 288, 287, 320, 60/321, 298, 605.2; 165/103, 157, 158, 172, 165/173, 297
See application file for complete search history.

(56) References Cited

U.S. PATENT DOCUMENTS 2,019,351 A 10/1935 Lantluop
3,734,177 A 5/1973 Bellovary et al.

(Continued)

FOREIGN PATENT DOCUMENTS

EP 0 942 156 9/1999

(Continued)

*Primary Examiner*—Stephen K Cronin
*Assistant Examiner*—Johnny H Hoang
(74) *Attorney, Agent, or Firm*—Jordan and Hamburg LLP

(57) ABSTRACT

A bypass duct portion is provided in a casing of an EGR cooler so that heat distortion is absorbed, and the EGR cooler body and a valve case are brazed/fixed together so as to improve strength of the valve case, whereby, the bypass duct portion is formed between an inner surface of the casing and the core, a switch is provided for switching and guiding the exhaust gas to either of the core or the bypass duct portion, and a number of outer ribs formed in the circumferential direction respectively are arranged side by side while being separated from each other in the longitudinal direction in the bypass duct portion of the casing to form a heat stress absorbing portion. Also provided is a cylindrical valve case that is integrally formed by deep drawing of a thin metal plate by a press machine, a pair of slits are provided at the rear end of the valve case, both edges of an intra-valve partition plate are inserted into the slits, support projection portions are provided on both faces of the both edge portions of the intra-valve partition plate, and the edge of the slit is supported by the support projection portion. An opening of the valve case is integrally brazed/fixed to an opening of a header portion of the casing.

7 Claims, 9 Drawing Sheets

U.S. PATENT DOCUMENTS

| | | | | |
|---|---|---|---|---|
| 4,473,111 | A * | 9/1984 | Steeb | 165/153 |
| 5,111,671 | A * | 5/1992 | Kadle | 62/515 |
| 5,282,507 | A | 2/1994 | Tongu et al. | |
| 5,720,341 | A * | 2/1998 | Watanabe et al. | 165/135 |
| 6,016,865 | A * | 1/2000 | Blomgren | 165/148 |
| 6,059,023 | A | 5/2000 | Kurematsu | |
| 6,102,111 | A | 8/2000 | Kamio et al. | |
| 6,141,961 | A | 11/2000 | Rinckel | |
| 6,269,870 | B1 | 8/2001 | Banzhaf et al. | |
| 6,293,337 | B1 | 9/2001 | Strahle et al. | |
| 6,321,835 | B1 * | 11/2001 | Damsohn et al. | 165/159 |
| 6,408,941 | B1 | 6/2002 | Zuo | |
| 6,807,955 | B2 * | 10/2004 | Leedham et al. | 123/568.12 |
| 6,898,930 | B2 * | 5/2005 | Nakatani et al. | 60/311 |
| 6,976,480 | B2 | 12/2005 | Miyoshi et al. | |
| 6,997,250 | B2 | 2/2006 | Dilley et al. | |
| 7,032,577 | B2 * | 4/2006 | Rosin et al. | 123/568.12 |
| 7,077,190 | B2 * | 7/2006 | Hayashi et al. | 165/159 |
| 7,159,649 | B2 | 1/2007 | Thyrum et al. | |
| 7,168,419 | B2 * | 1/2007 | Rosin et al. | 123/568.12 |
| 7,204,302 | B2 * | 4/2007 | Shibagaki et al. | 165/170 |
| 7,284,599 | B2 | 10/2007 | Karoliussen | |
| 7,287,579 | B2 * | 10/2007 | Dilley et al. | 165/167 |
| 7,311,090 | B2 * | 12/2007 | Lyons | 123/568.11 |
| 7,438,062 | B2 * | 10/2008 | Okawa et al. | 123/568.12 |
| 2005/0121173 | A1 * | 6/2005 | Inagaki et al. | 165/80.3 |
| 2006/0048926 | A1 | 3/2006 | Richter | |
| 2008/0087409 | A1 | 4/2008 | Nakamura | |
| 2008/0135221 | A1 | 6/2008 | Nakamura | |
| 2009/0194265 | A1 | 8/2009 | Nakamura | |

FOREIGN PATENT DOCUMENTS

| | | | |
|---|---|---|---|
| EP | 1 164 280 | | 12/2001 |
| EP | 1363012 | A1 * | 11/2003 |
| EP | 1555421 | A2 * | 7/2005 |
| EP | 1630403 | A1 * | 3/2006 |
| EP | 1746263 | A2 * | 1/2007 |
| JP | 60-147097 | | 8/1985 |
| JP | 60-150468 | | 8/1985 |
| JP | 63-088212 | | 4/1988 |
| JP | 5-018634 | | 1/1993 |
| JP | 10-122768 | | 5/1998 |
| JP | 2001-141388 | | 5/2001 |
| JP | 2002-318095 | | 10/2002 |
| JP | 2004-257366 | | 9/2004 |
| JP | 2004-278351 | | 10/2004 |
| WO | WO-02/10574 | | 2/2002 |
| WO | WO-03/060314 | | 7/2003 |
| WO | WO-2004/065876 | | 8/2004 |

* cited by examiner

EGR COOLER

BACKGROUND OF THE INVENTION

The present invention relates to an EGR cooler used for cooling an exhaust gas recirculation device of an automobile and particularly to those provided with a bypass duct portion for exhaust gas integrally with a casing of the EGR cooler.

A conventional EGR cooler is made of an assembly of a large number of flat tubes or a large number of plates, a large number of fins, a casing and a header, in which cooling water is made to communicate through the casing side and an exhaust gas is made to communicate inside each of the flat tubes or the like. If the temperature of the exhaust gas is at predetermined temperature or less, the gas is not to pass through the EGR cooler, but another bypass passage or a bypass integral with the EGR cooler is provided to be passed.

This is proposed in Japanese Patent Application Laid-Open No. 2004-278351 and Japanese Patent Application Laid-Open No. 2004-257366, for example.

The conventional EGR cooler requires a larger space as a whole when the bypass passage is provided separately.

The EGR cooler in which a part of the casing is used as a bypass passage has a large number of parts, which makes assembling cumbersome. Also, since the exhaust gas communicates only through a part of the casing at bypassing and not in a core portion, there is a fear that the casing is thermally expanded partially by the exhaust gas and a heat stress is applied to its connection portion, which could lead to breakage of a bonded portion.

Then, the present invention has an object to provide an EGR cooler in which the number of parts is small, assembling is easy, and even if a heat stress occurs at a part of the casing, it can be rationally absorbed.

Moreover, the present invention has another object to provide a reliable EGR cooler in which the EGR cooler and a bypass switching valve are integrally assembled and brazed/fixed all together so as to ensure sufficient strength.

SUMMARY OF THE INVENTION

The present invention in accordance with a first aspect thereof is an EGR cooler comprising a core (8) in which a flat first flow passage (3) and a second flow passage (4) are alternately arranged side by side, a casing (9) fitted to the outer periphery of the core (8), and header portions (31*a*) (31*b*) of an exhaust gas (12) arranged at both ends of the casing (9) in the longitudinal direction, wherein a bypass duct portion (18) is formed between the inner surface of the casing (9) and the core (8), and a switch (19) is provided for switching and guiding the exhaust gas (12) to either of the core (8) or the bypass duct portion (18).

The present invention in accordance with a second aspect thereof is an EGR cooler in accordance with the first aspect thereof, wherein the one header portion (31*a*) communicates with both the core (8) and the bypass duct portion (18) and is provided with one port (20); and the other header portion (31*b*) has a partition plate (21) inside separating the core (8) and the bypass duct portion (18) from each other, and two ports (22) (23) are formed on both sides with the partition plate (21) as a boundary.

The present invention in accordance with a third aspect thereof is an EGR cooler in accordance with the first or second aspect thereof, wherein the bypass duct portion (18) of the casing (9) is bent with a cross section in an arc state;

a heat stress absorbing portion (32) is provided in which a large number of inner ribs (32*c*) or outer ribs (27) are arranged side by side in the circumferential direction while being separated from each other in the longitudinal direction; and cooling water (10) is guided to the first flow passage (3) of the core (8) and the exhaust gas (12) is guided to the second flow passage (4).

The present invention in accordance with a fourth aspect thereof is an EGR cooler in accordance with a third aspect thereof, wherein the partition plate (21) is provided at the boundary between the core (8) and the bypass duct portion (18), and both ends of the ribs are formed only on the bypass duct portion (18) side rather than the partition plate (21) so as not to cross the edge portion of the partition plate (21).

The present invention in accordance with a fifth aspect thereof is an EGR cooler in accordance with a second aspect thereof, wherein an opening of an integrally formed cylindrical valve case (13) processed by deep-drawing of a thin metal plate by a press machine is brazed/fixed to an opening of the other header portion (31*b*), an intra-valve partition plate (14) dividing the valve case (13) into two parts is brazed/fixed inside the valve case (13), a rear-end edge portion of the intra-valve partition plate (14) is brazed to a tip end edge portion of the partition plate (21), a pair of slits (13*b*) conforming to the plate thickness of the intra-valve partition plate (14) are provided at the rear end of the valve case (13), both edges of the intra-valve partition plate (14) are inserted into the slits (13*b*), support projection portions (14*a*) are formed on both faces of the both edge portions of the intra-valve partition plate (14) so that they support the inner edges of the slits (13*b*), a valve shaft (13*a*) is inserted through the valve case (13), and a core opening/closing valve (16*a*) and a bypass opening/closing valve (16*b*) are fixed to the respective valve shaft (13*a*) and provided on both sides of the intra-valve partition plate (14) so as to cross perpendicularly each other so that the cooling water (10) is guided to the first flow passage (3) on the core (8) and the high-temperature exhaust gas (12) is made to selectively communicate with the second flow passage (4) side or the bypass duct portion (18) side of the core (8) through rotating driving of the valve shaft (13*a*).

The present invention in accordance with a sixth aspect thereof is an EGR cooler in accordance with a fifth aspect thereof, wherein the outer periphery of the valve case (13) is formed with a substantially rectangular section and a flat center part at each of four peripheries except a tip-end opening edge portion, and the tip-end edge portion has a swollen portion (13*e*) with a small oval section with the entire both sides formed by projecting curved faces, its tip-end edge portion conforms to the opening of the header portion (31*b*), and they are fitted with each other and brazed/fixed; and the valve shaft (13*a*) is inserted into the side of the substantially rectangular section of the valve case (13).

The present invention in accordance with the seventh aspect thereof is an EGR cooler in accordance with the fifth or sixth aspect thereof, wherein a reinforcing body (19*d*) made of a press formed body of a metal plate thicker than the plate thickness of the valve case (13) and having a flange portion (19*a*) adjacent to the tip-end opening edge portion of the valve case (13) is provided, a side edge portion (19*b*) extended integrally from the peripheral edge of the flange portion (19*a*) is brazed to the outer face of the tip-end portion of the casing (9), and a valve driving body (15) is mounted to the side edge portion (19*b*) of the reinforcing body (19*d*).

The present invention in accordance with an eighth aspect thereof is an EGR cooler in accordance with any of the first to seventh aspects thereof, wherein in the core (8), a core body (5) is formed in which a strip-shaped metal plate is turned up and bent in a fanfold manner with turned-up end edges (1), (2) alternately formed at one end and the other end of a rectangular flat face portion (1*a*), and flat first flow passages (3) and second flow passages (4) are provided alternately in the thickness direction of the metal plate, the first flow passages (3) of the core body (5) is blocked by a comb-state member (6) made of an elongated plate material or rod material at both end positions of the turned-up end edge (1), and a fin (7) is set within the second flow passages (4), the outer periphery of the core body (5) is fitted with the cylindrical casing (9) so as to block the adjacent turned-up end edges (1), (2), and the first fluid (10) is guided to each of the first flow passages (3) by a pair of ports (11) on the outer face of the casing (9), while the exhaust gas (12) is guided from one of cylindrical openings of the casing (9) to the other opening through each of the second flow passages (4).

The EGR cooler of the present invention is constructed as above and has the following effects.

Since a heat exchanger of the present invention is provided with the bypass duct portion 18 formed between the inner surface of the casing 9 and the core 8 and the switch 19 for switching and guiding the exhaust gas 12 to either of the core 8 or the bypass duct portion 18, an integrated and compact EGR cooler having a bypass passage can be provided in which the number of part is small and assembling is easy.

In the above construction, both the core 8 and the bypass duct portion 18 can be made to communicate with the one header portion 31*a*, and the other header portion 31*b* can be provided with the partition plate 21 for separating the both. By this, an integrated and compact EGR cooler having a bypass passage whose construction is simple can be provided.

In the above construction provided with the heat stress absorbing portion 32 in which a large number of the inner ribs 32*c* or the outer ribs 27 are arranged side by side in the circumferential direction while being separated from each other in the longitudinal direction of the bypass duct portion 18 of the casing 9, when the exhaust gas 12 communicates through the bypass duct portion 18, even if only the duct portion 18 side is thermally swollen, it is absorbed by the heat stress absorbing portion 32, and application of an excessive heat stress on a connection part to be connected to the casing 9 can be prevented.

In the above construction, if the partition plate 21 is provided at the boundary between the core 8 and the bypass duct portion 18, and the partition plate 21 is formed so as not to be crossed by both ends of the rib, air tightness of the partition plate 21 can be easily ensured.

In the above construction, in a state where the cylindrical valve case 13 processed by deep-drawing of a thin metal plate by a press machine is provided, inside of which is partitioned by the intra-valve partition plate 14, they are brazed/fixed to the header portion 31*b* of the casing 9 and the partition plate 21, a pair of slits 13*b* are provided at the rear end of the valve case 13, the inner edges of the slits 13*b* are supported by the support projection portions 14*a* while both sides of the intra-valve partition plate 14 are inserted into the slits 13*b*, the valve case 13 and the opening of the header portion 31*b* are brazed/fixed, and the intra-valve partition plate 14 and the partition plate 21 are integrally brazed/fixed, an EGR cooler with opening/closing valve can be provided, manufacturing of which is easy, accuracy as well as strength are high, and a cost is low. That is, by the above construction, the valve case 13 whose inside is accurately divided into halves can be obtained. And the support projection portions 14*a* are formed at both edges at the rear end of the intra-valve partition plate 14 and they are constructed so as to support the inner edges of the slits 13*b* of the valve case 13. Therefore, a reliable EGR cooler with opening/closing valve in which the vicinity of the slits 13*b* of the valve case 13 is reinforced so as to prevent deformation can be provided.

In the above construction where only the tip end portion of the valve case 13 is formed with an oval section, the swollen portion 13*e* is provided thereon and the tip end portion is fitted/fixed to the opening of the header portion 31*b*, conformity between the valve case 13 and the header portion 31*a* can be accurately ensured and reliability of brazing can be improved. Also, since the valve shaft 13*a* is inserted through the side portion of the rectangular section, the seal structure of the insertion portion can be realized easily.

In the above construction, the reinforcing body 19*d* is formed by a press formed body of a metal plate thicker than the plate thickness of the valve case 13, the flange portion 19*a* is adjoined to the opening edge of the tip end portion of the valve case 13, and the side edge portion 19*b* is brazed/fixed to the outer face of the tip end portion of the casing 9 so that the valve case 13 can be reinforced. And the EGR cooler can be firmly connected to a piping and the like through the flange portion 19*a*. Also, by mounting the valve driving body 15 to the side edge portion 19*b* of the reinforcing body 19*d*, the driving can be secured.

In the above construction in which the core body 5 is formed by bending a strip-shaped metal plate in a fanfold manner, the core 8 is constructed by the core body 5, the comb-state member 6 and the fin 7, and the outer periphery of the core 8 is fitted with the casing 9, an EGR cooler that the number of parts is small, manufacture is easy and structure is simple can be provided.

Moreover, fewer connection portions improve the air tightness and liquid tightness and enable a compact EGR cooler with a good performance.

BRIEF DESCRIPTION OF THE DRAWINGS

FIG. 7 shows a connection state between a valve case 13 and an intra-valve partition plate 14 of the EGR cooler, in which

DETAILED DESCRIPTION OF THE INVENTION

Next, embodiments of the present invention will be described based on the attached drawings.

Figure 1:
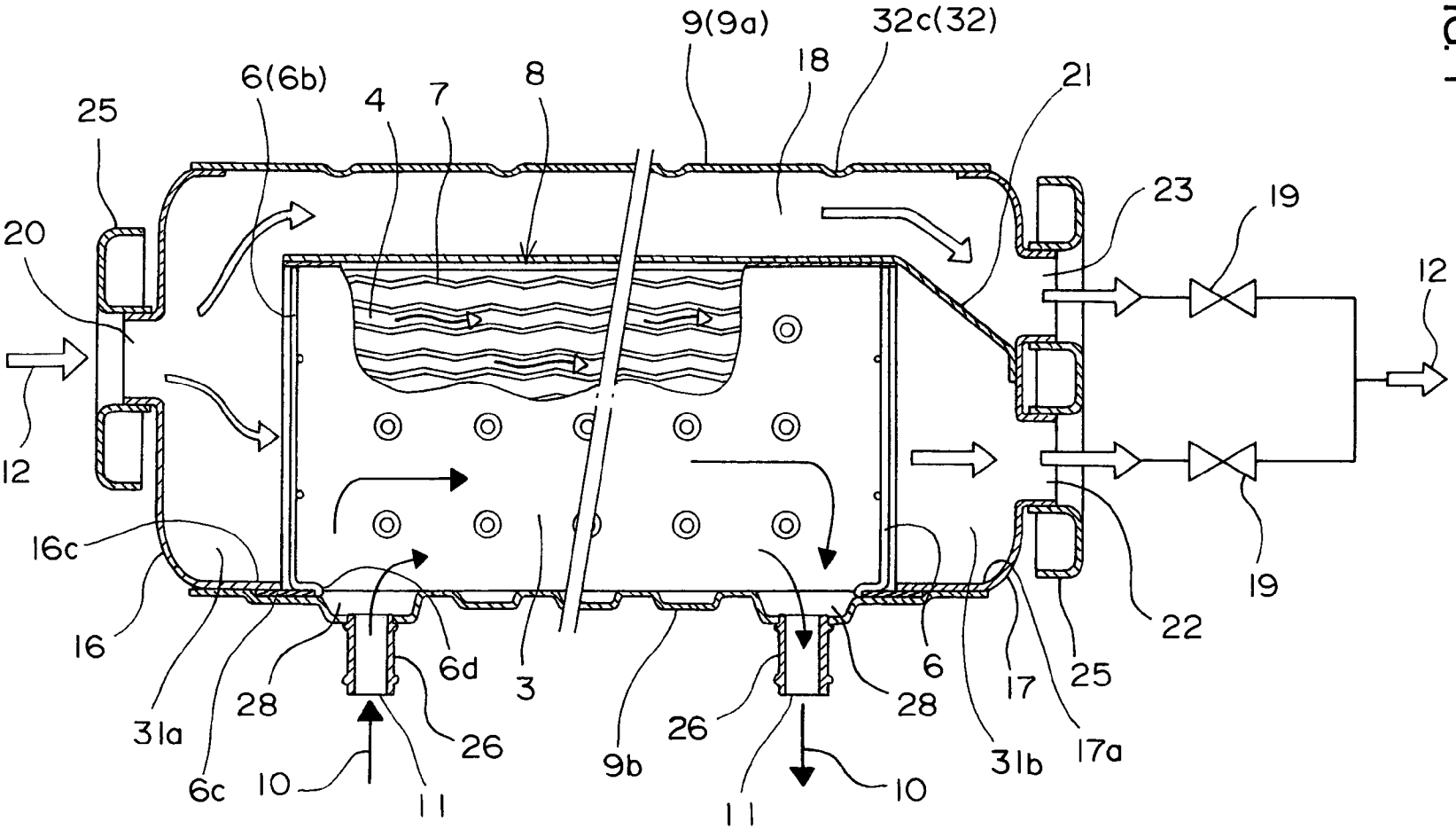
FIG. 1 is a longitudinal sectional view of an EGR cooler body of the present invention.
Figure 2:
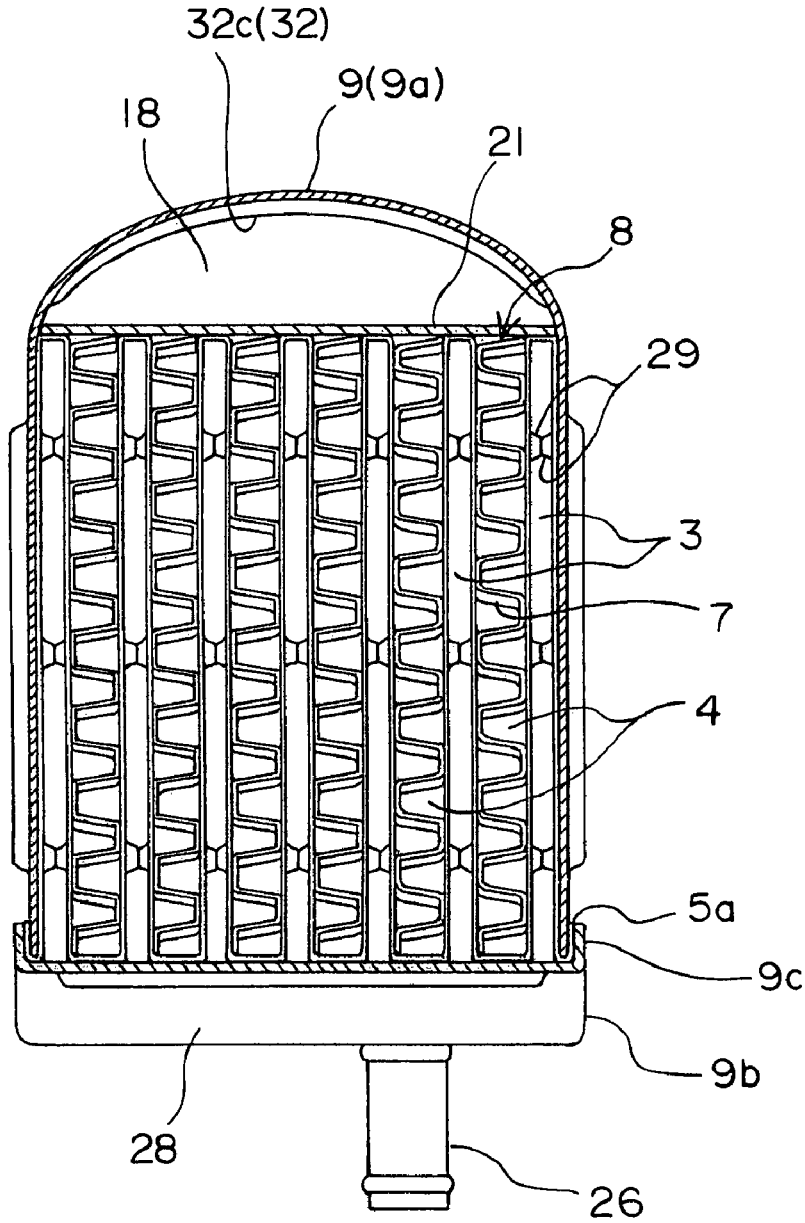
FIG. 2 is a cross sectional view of the same.
Figure 3:
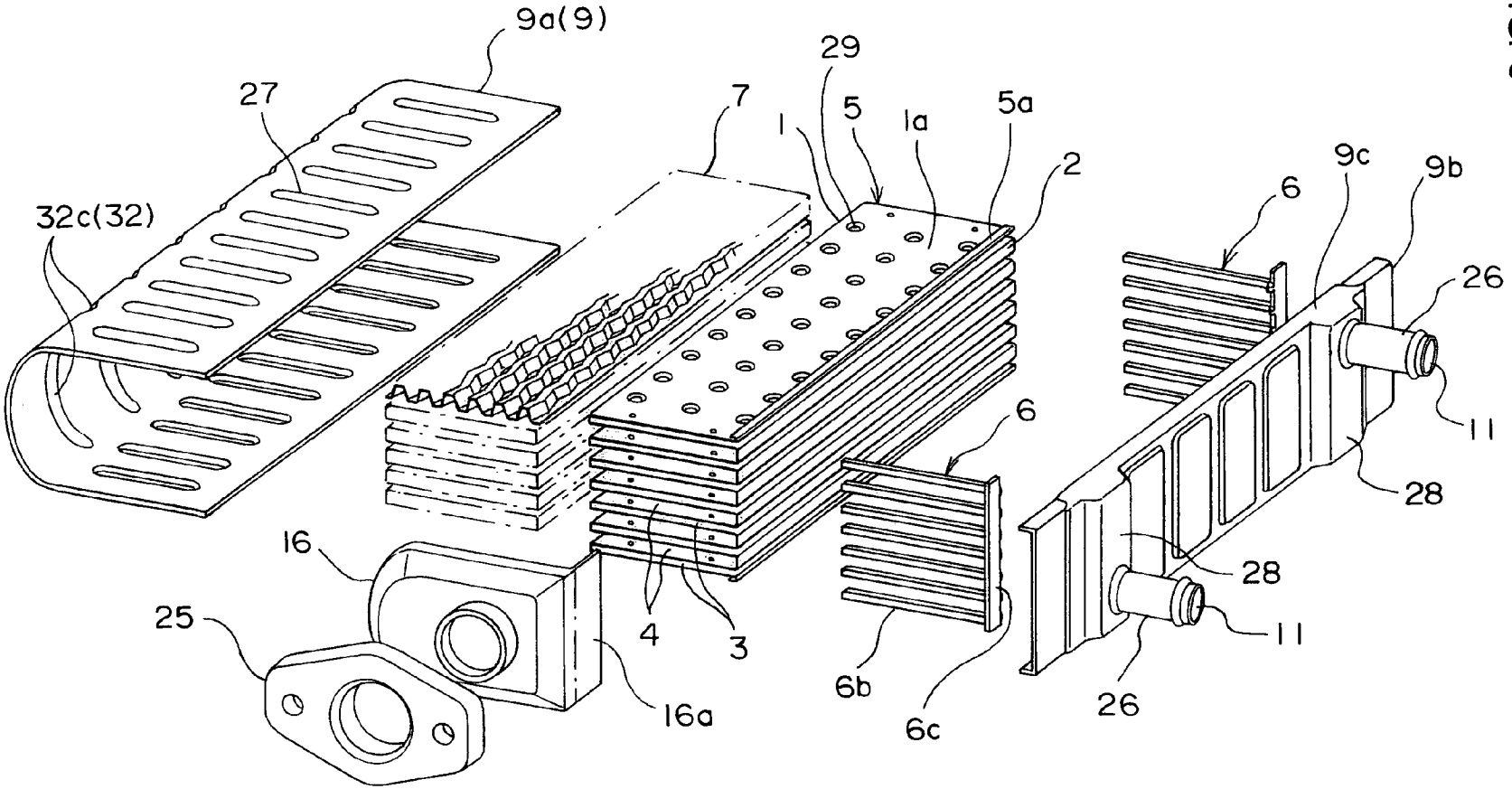
FIG. 3 is an exploded perspective view of the EGR cooler at the center part (except a partition plate).
Figure 4:
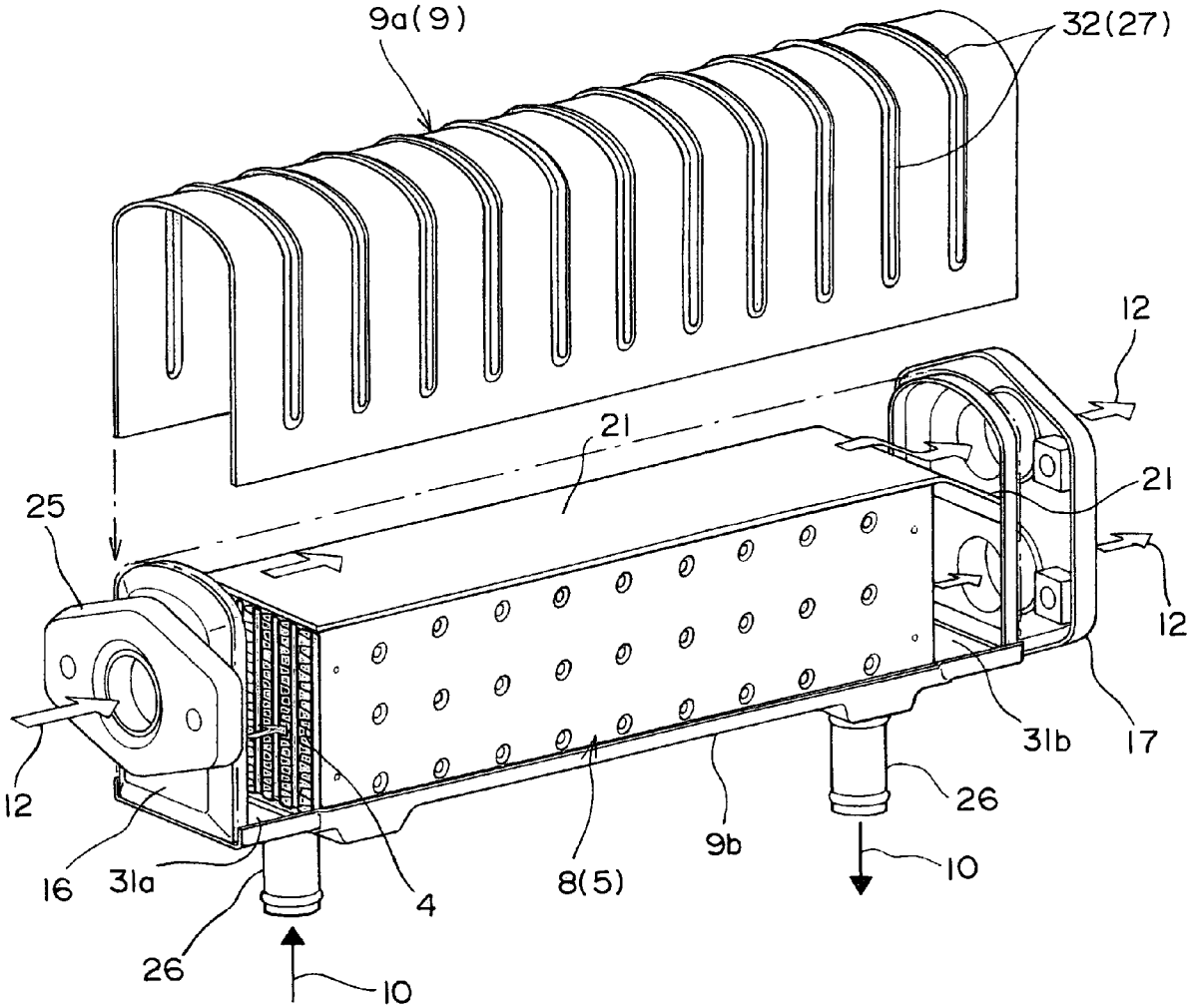
FIG. 4 shows another EGR cooler of the present invention illustrating a state where a part of a casing 9 is removed from the assembled state.
Figure 5:
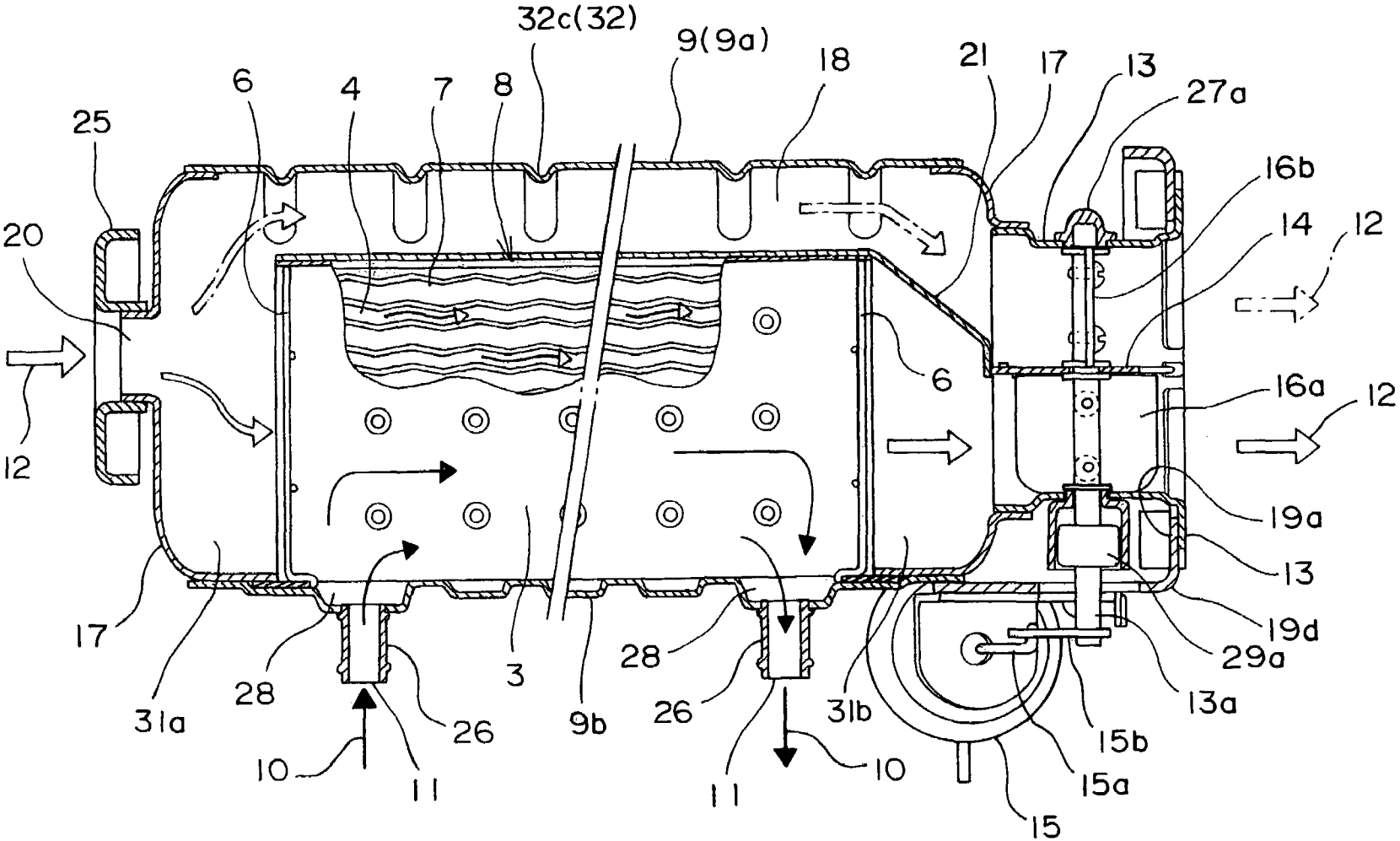
FIG. 5 is a longitudinal sectional view of still another EGR cooler of the present invention.
Figure 6:
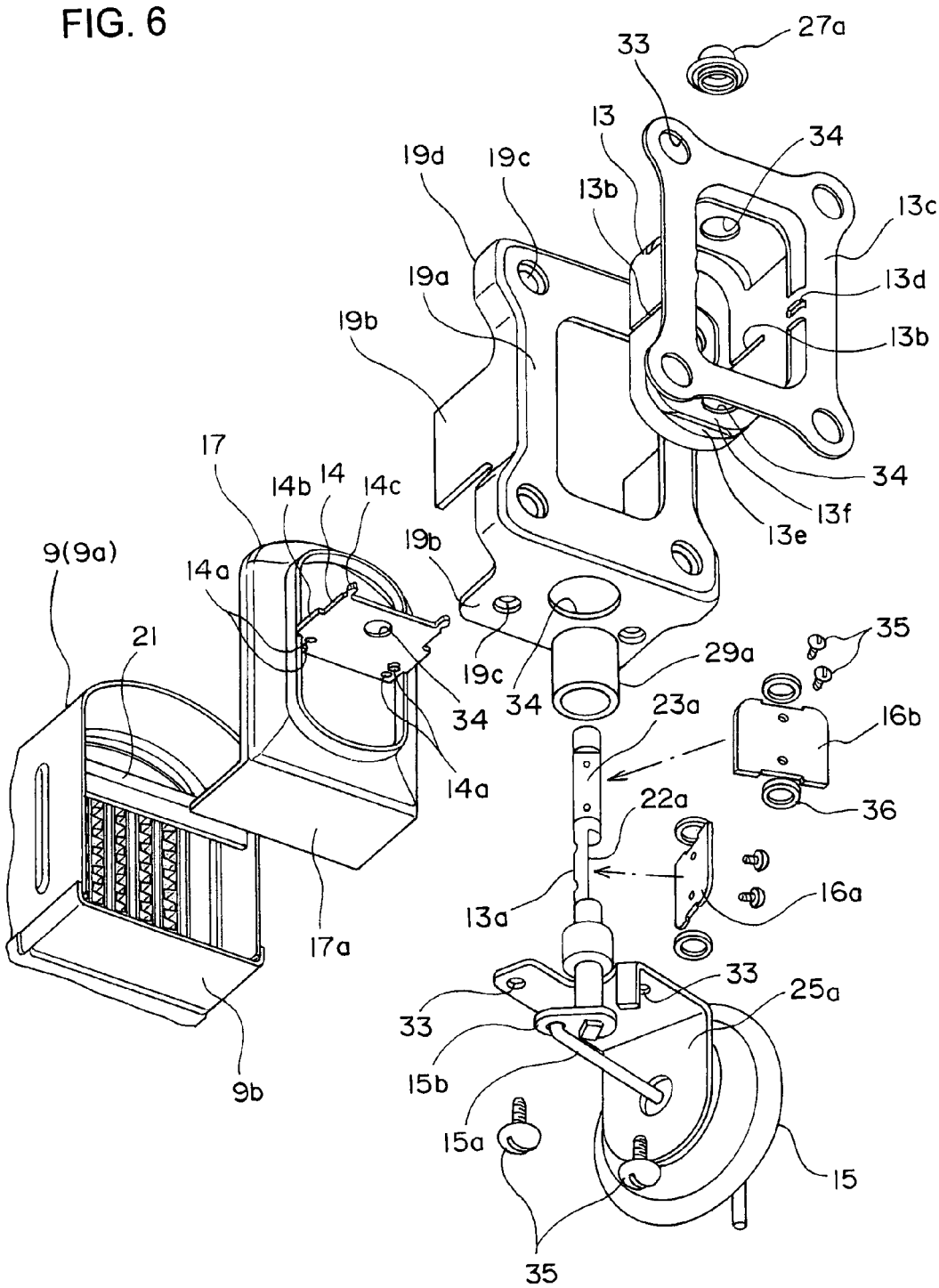
FIG. 6 is an exploded perspective view of a valve portion of the EGR cooler.
Figure 7A:
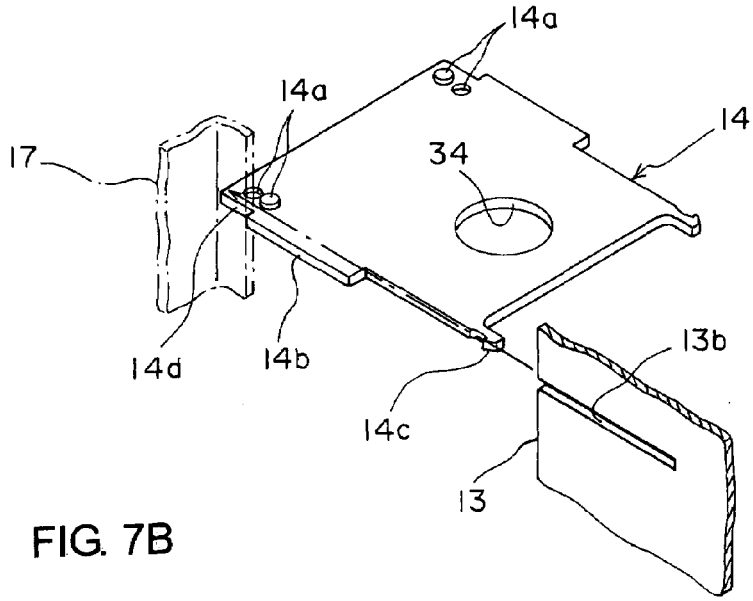
FIG. 7A is an explanatory perspective view of essential parts.
Figure 7B:
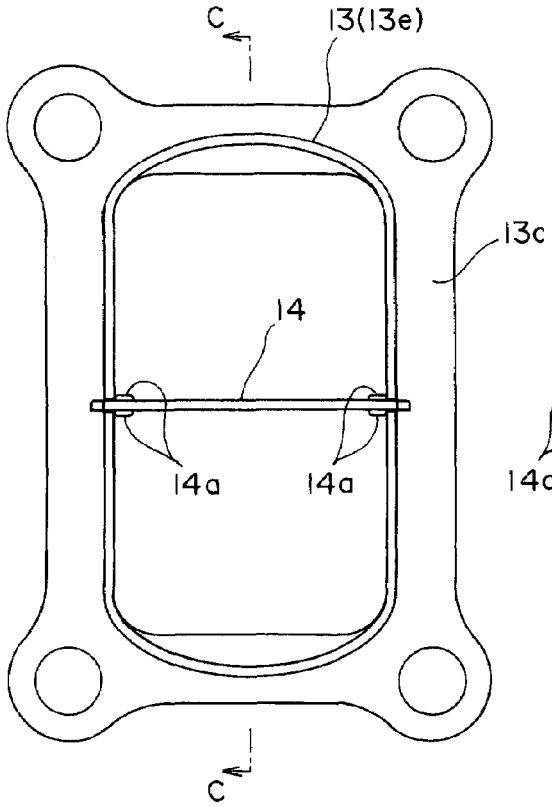
FIG. 7B is a view on arrow B-B in FIG. 7C.
Figure 7C:
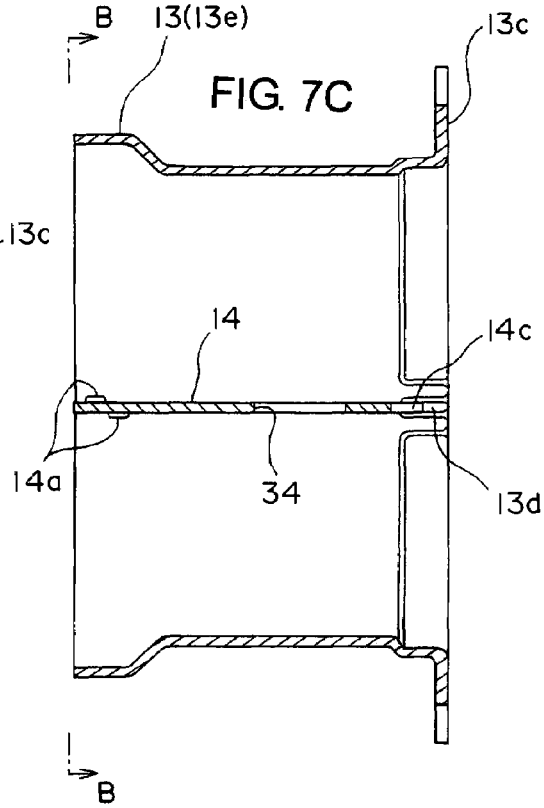
FIG. 7C is a sectional view on arrow C-C in FIG. 7B.
Figure 8:
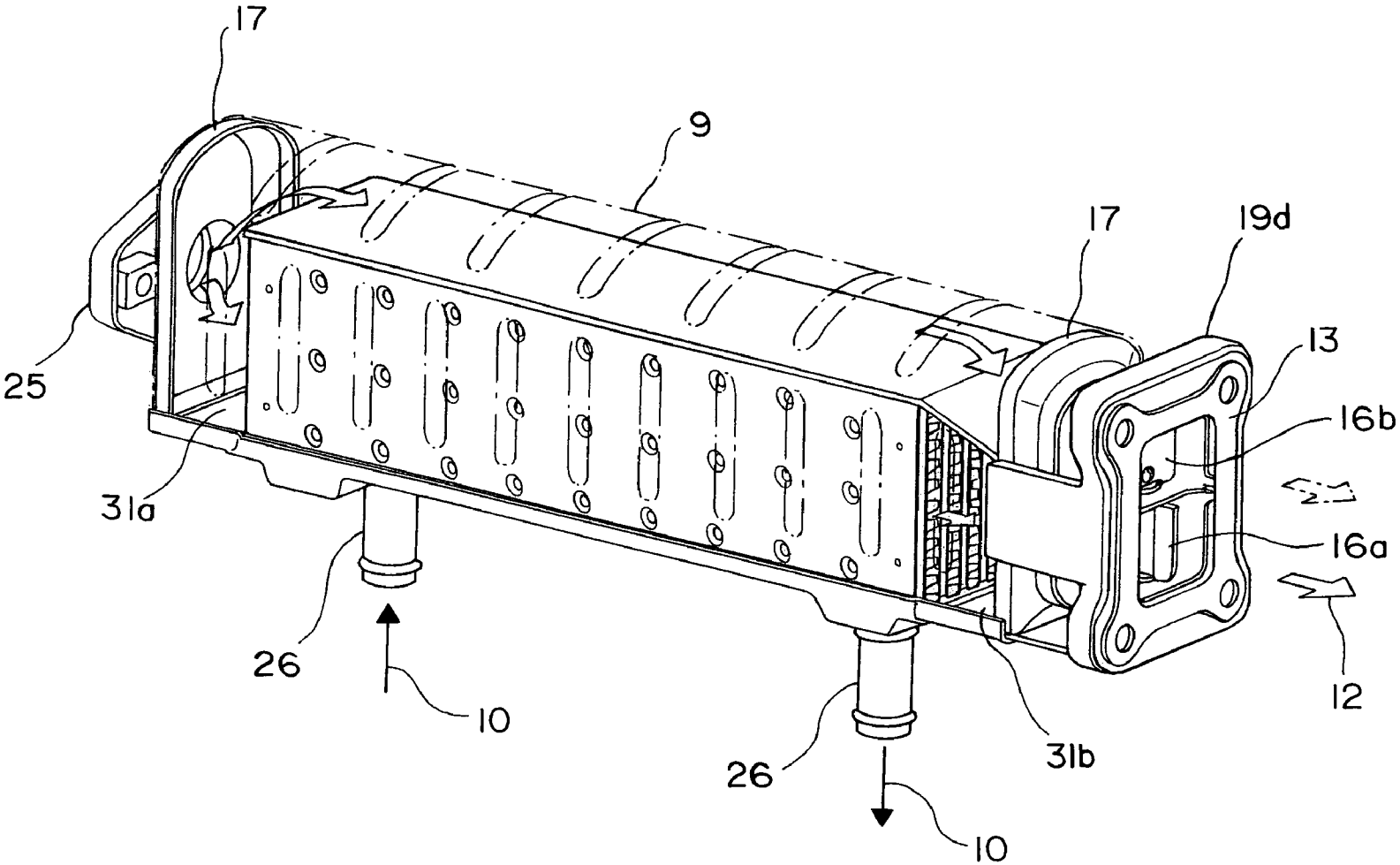
FIG. 8 is a perspective view of the EGR cooler illustrating a state where a part of the casing 9 is removed from the assembled state.
Figure 9:
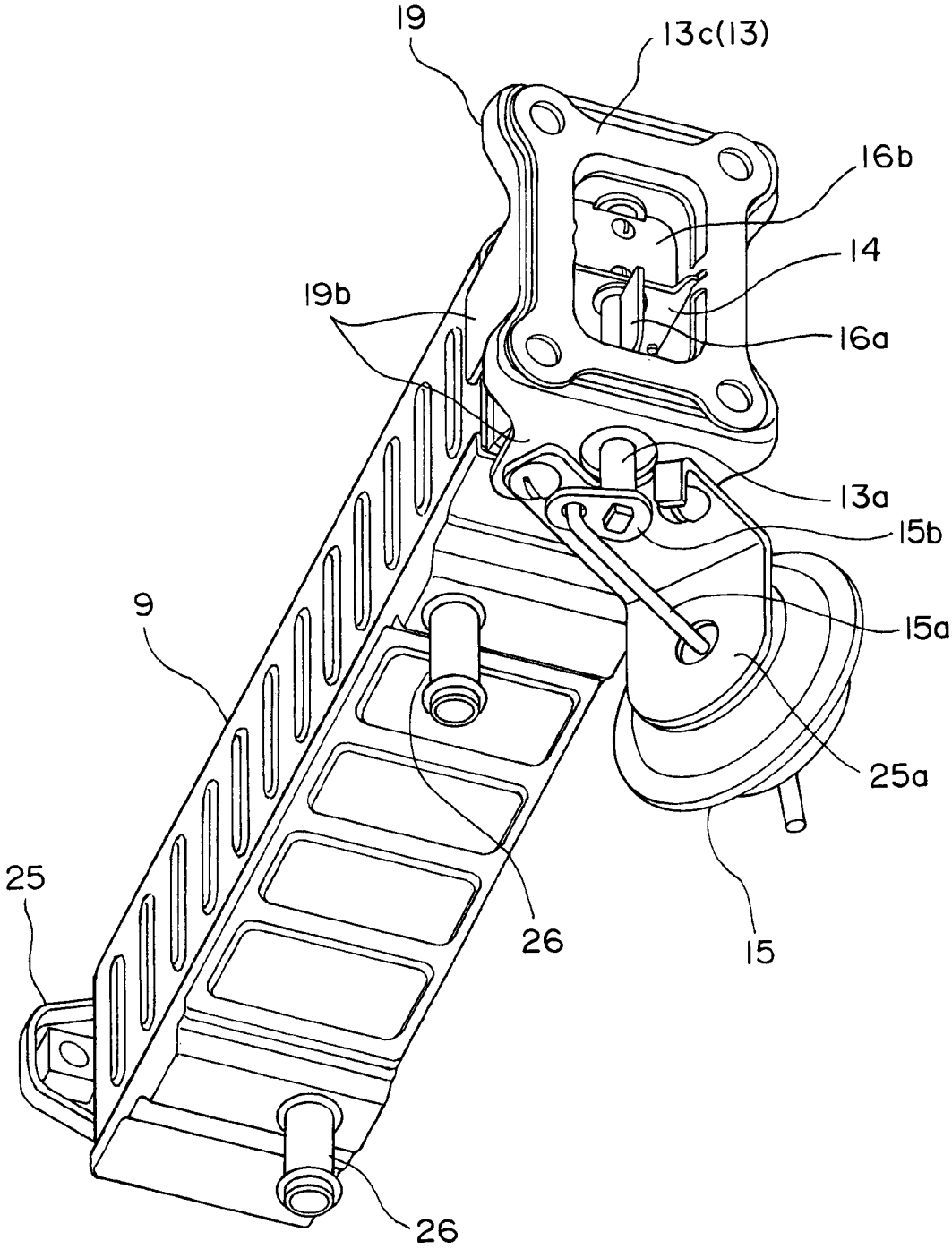
FIG. 9 is a perspective view illustrating the assembled state of the EGR cooler.

FIG. 1 is a longitudinal sectional view of an EGR cooler body of the present invention, FIG. 2 is its cross sectional view, FIG. 3 is an exploded perspective view of the EGR cooler at the center part (a partition plate is omitted), FIG. 4 is a partially exploded perspective view of another EGR cooler of the present invention, FIG. 5 is a longitudinal sectional view of still another embodiment, FIG. 6 is an exploded perspective view of its valve portion, FIG. 7 is an assembly explanatory view, FIG. 8 is a partially omitted assembly perspective view of the EGR cooler, and FIG. 9 is an assembly perspective view of the EGR cooler.

The EGR cooler shown in FIGS. 1 to 3 has a core body 5, a large number of fins 7, a casing 9, a pair of headers 16, 17, and a pair of comb-state members 6.

The core body 5 is comprised by turning up and bending a strip-shaped metal plate in a fanfold manner as shown in FIG. 3 so that turned-up end edges 1, 2 are formed alternately at one end and the other end of a rectangular flat face portion 1*a*, and flat first flow passages 3 and second flow passages 4 are provided alternately in the thickness direction of the metal plate. In this example, a space of the first flow passage 3 is formed smaller than that of the second flow passage 4. It is needless to say that the spaces of the both can be the same or vice versa.

A large number of dimples 29 are formed on the first flow passage 3 side of the strip-shaped metal plate. In this example, the opposing dimples 29 are brought into contact with each other at their tip ends so as to hold the space of the first flow passage 3 constant. To each of the first flow passages 3, each of the comb-state members 6 is fitted at the both end positions of the turned-up end edges 1, and the fitted portions are integrally brazed/fixed.

In the comb-state member 6, a tooth base 6*c* is provided at a right angle with a come tooth 6*b*, and a root 6*d* of the comb tooth 6*b* is bent in the L-shape along the comb base 6*c*.

The comb-state member 6 constructed as above has, as shown in FIG. 1, its tooth base 6*c* in contact with the end face of the turned-up end edge 2, and the root 6*d* is in contact with the corner part so that a brazed area of each contact portion is large. By this, reliability of brazing is improved.

Next, each of the fins 7 is set within each of the second flow passages 4 as shown in FIG. 3. This fin 7 is formed by bending a metal plate in the waveform in the cross sectional direction and also in the longitudinal direction of its ridge line and trough portion so as to improve agitating effect of the exhaust gas communicating through the second flow passage 4.

A core 8 (FIG. 1) is constituted by an assembly of the core body 5, the comb-state member 6 and the fins 7 as above.

Next, the casing 9 fitted over the outer periphery of this core 8 is formed in the cylindrical shape with a rectangular section longer than the length of the core 8 and has a pair of header portions 31*a*, 31*b* (See FIG. 1) outside the both ends of the core 8. This casing 9 is comprised by a channel-state body 9*a* and a lid body 9*b* in this embodiment as shown in FIGS. 1 and 3.

The channel-state body 9*a* formed with a section in the U-shape has its inner circumferential face in contact with both upper and lower faces of the core body 5 and a bypass duct portion 18 is formed between the channel bottom portion and the core body 5 (FIG. 2). And a partition plate 21 is opposed to the channel bottom portion and brought into contact with one side of the core body 5 and blocks between the adjacent turned-up end edges 1 of the core body 5. By this, the side face of the second flow passage 4 is blocked. The lid body 9*b* blocks the opening side of the channel-state body 9*a* and the other side of the core body 5 and also blocks between the adjacent turned-up end edges 2.

And in FIG. 1, the left-side header portion 31*a* communicates with the bypass duct portion 18 and each of the second flow passages 4, while the right-side header portion 31*b* separates the bypass duct portion 18 and the core 8 by the partition plate 21. And one port 20 is provided for one header portion 31*a*, while a pair of ports 22, 23 are provided for both sides of the other header portion 31*b* divided by the partition plate 21 as the boundary. Moreover, in this embodiment, a piping is connected to each of the port 22 and the port 23, and a switch 19 is provided in the respective piping.

The channel-state body 9*a* is made of high heat-resistant/corrosion-resistant nickel steel, stainless steel or the like and prevents damage from the high-temperature exhaust gas 12 communicating through the inner surface. On the other hand, since the lid body 9*b* has the cooling water 10 communicating through the inner surface thereof, it may have poorer heat resistance or corrosion resistance than those of the channel-state body 9*a*. In general, stainless steel plate with poorer heat resistance or corrosion resistance has better forming performance than that of the high heat resistant/corrosion resistant material, and the material is inexpensive. In this embodiment, the lid body 9*b* is formed with a pair of small tank portions 28 projected/molded by press work on the outer face side at the both end positions as shown in FIG. 1, in which ports 11 are opened, respectively, and pipes 26 are connected to the ports 11. By using a stainless steel plate with poor heat resistance/corrosion resistance to some degree, processing of this small tank portion 28 is facilitated.

The tip end edges of the both side walls of the channel-state body 9*a* are fitted to a fitting edge portion 5*a* (FIG. 3) turned up and formed at both upper and lower ends of the core body 5. A flange portion 9*c* of the L-shaped sectional portion turned up at a right angle at both upper and lower ends of the lid body 9*b* is fitted over the outer face side of the fitting edge portion 5*a*.

The channel-state body 9*a* has its bottom portion curved with a section in the arc state (U-shaped) as mentioned above. And a large number of inner ribs 32*c* are formed in the circumferential direction separately from each other in the longitudinal direction at the curved portion so as to constitute a heat stress absorbing portion 32. On both side faces of the channel-state body 9*a*, a large number of outer ribs 27 are formed. The heat stress absorbing portion 32 is formed in the arc state, and its both ends reach the vicinity of the partition plate 21 but do not cross the both side-edges of the partition plate 21. By this, air tightness of the bypass duct portion 18 side and the core 8 side is ensured easily.

The inner ribs 32*c* project to the inner face side, but instead of that, the outer ribs may be projected/formed to the outer face side.

And it is constructed such that the exhaust gas 12 selectively communicates through either the bypass duct portion 18 side or the core 8 side by the switch 19 provided outside of the header end lid 17. In this embodiment, the exhaust gas 12 flows into the header portion 31*a* from the left-side port 20 in FIG. 1. If the temperature of the exhaust gas 12 is relatively high, the core 8 side of the switch is opened, while the bypass side is closed so that the exhaust gas 12 is guided into the second flow passage 4 of the core 8. The cooling water 10 communicates through the first flow passage 3 of the core 8, heat is exchanged with the exhaust gas 12, and the exhaust gas 12 is cooled and guided to the outside.

If the temperature of the exhaust gas 12 is relatively low at the start of an engine or the like, the switch 19 is switched to the bypass side and the exhaust gas 12 is made to communicate through the bypass duct portion 18 side. Then, with the communication of the exhaust gas 12, only the bypass duct portion 18 is heated. Consequently, only the upper part of the channel-state body 9*a* in FIGS. 1 and 2 is thermally expanded. This thermal expansion is absorbed by presence of the large number of heat stress absorbing portions 32. By that, application of excessive heat stress on a joint portion between the casing 9 and the header end lids 16, 17 and the like is prevented as a whole.

Next, the opening ends of the header portions 31*a*, 31*b* at both ends of the casing 9 in the longitudinal direction are blocked by a pair of header end lids 16, 17 made of a high heat-resistant/corrosion-resistant material, and flanges 25 are fitted to the outside thereof. The header end lids 16, 17 are swollen outward in the pot shape in this embodiment, and inlet/outlet port for the exhaust gas 12 are opened at the center. Moreover, on one side of each of the header end lids 16, 17, extension portions 16*c*, 17*a* are integrally extended and the extension portions 16*c*, 17*a* cover the inner surfaces of the both ends of the lid body 9*b* as shown in FIG. 1.

A brazing material covers or is arranged between each connection portion of this EGR cooler, and the whole in the assembled state shown in FIG. 1 is integrally brazed/fixed in a high-temperature furnace.

And as shown in the same figure, the cooling water 10 is supplied to each of the first flow passages 3 through one of the pipes 26, the small tank portions 28 projected on one side of the casing 9, communicates in the longitudinal direction and flows out of the other pipe 26. Also, the high-temperature exhaust gas 12 is supplied to each of the second flow passages 4 of the core 8 from the opening of the header end lid 16 through the opening of the casing 9.

A pair of comb-state members 6 (FIG. 1) constitute the header plates.

Next, FIG. 4 is another embodiment of the channel-state body 9*a* of the casing 9, and a difference between this embodiment and the embodiment in FIG. 1 is the heat stress absorbing portion 32 of the channel-state body 9*a*, in which the outer ribs 27 are provided in the arc-state portion and extended to the both sides of the casing. In this case, it is necessary that projection portions are provided at both side-edges of the partition plate 21 in FIG. 1 so as to conform to the outer ribs 27, and the bypass duct portion 18 side should be separated from the core 8 side in FIG. 2.

As shown in FIG. 4, if the heat stress absorbing portion 32 is formed by the outer rib 27, the heat expansion at bypassing of the exhaust gas is performed by deformation of only a part of the outer rib 27.

That is because the cooling water 10 communicates through the core 8 even at the bypassing of the exhaust gas 12, and the portion adjacent to the core 8 is kept at a relatively low temperature. Thus, the higher the temperature is, the farther the bypass duct portion 18 is separated from the core 8.

Next, FIG. 5 is a longitudinal sectional view of the EGR cooler of another embodiment of the present invention and shows the EGR cooler with bypass switching valve. FIG. 6 is an exploded perspective view of a valve member, FIG. 7 is an explanatory view illustrating an assembled state of an intra-valve partition plate 14 and a valve case 13, in which FIG. 7A is a perspective view of essential parts, FIG. 7B is a view on arrow B-B in FIG. 7C, and FIG. 7C is a C-C sectional view in FIG. 7B. FIG. 9 is a perspective view illustrating an assembled state of the EGR cooler and FIG. 8 is a perspective view illustrating a state where a part of the casing 9 is removed.

In the EGR cooler of this embodiment, the cooler body and an opening/closing valve are integrally formed. That is, as shown in FIG. 5, the valve case 13 is brazed/fixed to one end of the header end lid 17. The valve case 13 has an intra-valve partition plate 14, both sides of which a core opening/closing valve 16*a* and a bypass opening/closing valve 16*b* are incorporated and their valve shaft 13*a* is connected to a valve driving body 15 through a first link 15*a* and a second link 15*b*. A reinforcing body 19*d* is fitted over the outside of the valve case 13.

The main body of the EGR cooler has, as with another embodiment, the core 8, the casing 9 containing it, and the pair of header end lids 17 blocking its both ends, the partition plate 21 is provided on the upper face side of the core 8, and the pair of header portions 31*a*, 31*b* are provided between both ends of the core 8 in the longitudinal direction and the header end lids 17. In this figure, the right-side header portion 31*b* is divided into halves by an extension portion of the partition plate 21. And the bypass duct portion 18 is provided between the outer face of the partition plate 21 of the core 8 and the inner face of the casing 9.

In FIG. 6, the opening of the header end lid 17 is formed in the oval shape as shown in the figure. That is, at the opening, flat portions in parallel with each other are formed at right and left, and upper and lower parts connecting them are formed in the arc state. To this opening of the header end lid 17, the rear end edge of the valve case 13 conforming to it is brazed/fixed. The valve case 13 is made of an integrally formed cylindrical body processed by deep-drawing of a thin metal plate by a press machine, and a flange portion 13*c* is projected/formed at the tip end. Also, at the rear end of a cylindrical portion of the valve case 13, a pair of slits 13*b* are formed oppositely to each other. An intermediate portion of the cylindrical portion of the valve case 13 has its both upper and lower faces and both side faces formed to be flat. And the outer periphery of the rear end of the cylindrical portion of the valve case 13 is formed in the oval shape conforming to the opening of the header end lid 17. That is, both upper and lower ends of the cylindrical portion of the valve case 13 have flat portions 13*f*, and a projected portion 13*e* is integrally formed from its rear end. This flat portion 13*f* keeps favorable conformance with the end edge of a spacer 29*a*, which will be described later. And by providing the projected portion 13*e* at the valve case 13, the conformance with the opening of the header end lid 17 is kept favorable.

Next, to the slit 13*b* of the valve case 13, as shown in FIG. 7, a stepped portion 14*b* of the intra-valve partition plate 14 is fitted, and the both are integrally brazed/fixed. At both edge portions at the rear end of the intra-valve partition plate 14, support projection portions 14*a* are projected/formed on its both faces. This support projection portion 14*a* is projected by press forming in the so-called half-blanking sate. That is, in the forming process of a punch hole to form a hole by press, the hole is not completely punched out but punched about the half of the plate thickness. The support projection portion 14*a* is formed at a position in contact with the inner circumferential edge of the slit 13*b*. On both sides of the intra-valve partition plate 14, the stepped portion 14*b* is projected/formed at the rear end side by the twice plate thickness of the valve case 13. The length of the stepped portion 14*b* is slightly shorter than the length of the slit 13*b* of the valve case 13. And the step of the cutaway portion 14*d* at its rear end is the plate thickness of the valve case 13. To the cutaway portion 14*d*, the inner face of the opening of the header end lid 17 is brought into contact with and fixed. And the rear-end edge portion of the valve case 13 is inserted between the opening of inner face of the header end lid 17 and the support projection portion 14*a*.

Also, an end portion 14*c* is projected at the tip end portion of the intra-valve partition plate 14. This end portion 14*c* is fitted with a recess portion 13*d* on the inner face at the position close to the flange portion 13*c* of the valve case 13 (FIG. 7A, FIG. 6). Also, at the intra-valve partition plate 14 and the valve case 13, through holes 34 through each of which the valve shaft 13*a* penetrates are formed. On this valve shaft 13*a*, as shown in FIG. 6, a pair of cutaway portions 22*a* and 23*a* are formed separately from each other in the axial direction. Both have planes different from each other in the circumferential direction by 90 degrees. And the core opening/closing valve 16*a* is fixed to the cutaway portion 22*a* and the bypass opening/closing valve 16*b* to the cutaway portion 23*a* through mounting screws 35 and the like. The tip end portion of the valve shaft 13*a* is rotatably supported by a bearing 27*a* fitted/fixed to the through hole 34 of the valve case 13 by brazing. The rear end portion of the valve shaft 13*a* is connected to the valve driving body 15 through the second link 15*b* and the first link 15*a*. In the valve driving body 15, the first link 15*a* is moved in the axial direction according to the temperature of the exhaust gas.

Next, the flange portion 19*a* of the reinforcing body 19*d* is adjoined to the flange portion 13*c* of the valve case 13. This reinforcing body 19*d* is made of a metal plate with the plate thickness larger than that of the valve case 13 and produced by press forming of the metal plate. At the tip end of the reinforcing body 19*d*, the inner-flange state flange portion 19*a* is provided, and bolt holes 19*c* are formed at the four corners. The bolt holes 19*c* conform to holes 33 provided at four corners of the flange portion 13*c* of the valve case 13. The reinforcing body 19*d* has three side edge portions 19*b* integrally extended from three sides of the cylindrical peripheral edge portion and its peripheral edge with a slight width. The side edge portion 19*b* is welded/fixed to the tip end edge of the casing 9, respectively, at the rear end edge as shown in FIG. 9.

Next, at the lid body 9*b* of the casing 9, the pair of small tanks 28 are provided separately in the longitudinal direction, and the tip ends of the pipes 26 are bonded to the small tanks 28.

Each part constructed as above is made of an aluminum material, as an example, and those with a brazing material coating at least one surface in contact with each other are used. And the core 8 is assembled, and the casing 9 is fitted with its outer periphery. And the header end lids 17 are fitted with the both ends, and the flange 25 is fitted to the one header end lid 17, while the valve case 13 is fitted with the other header end lid 17. To the valve case 13, the intra-valve partition plate 14 and the bearing 27*a* are mounted in advance, and the flange portion 19*a* of the reinforcing body 19*d* is brought into contact with the flange portion 13*c* of the valve case 13. And into the slit 13*b* of the valve case 13, the intra-valve partition plate 14 is inserted. The EGR cooler assembled as above is put into a high-temperature furnace and the whole is integrally brazed/fixed. The spacer 29*a* is bonded to the hole edge portion of the through hole 34 of the flat portion 13*f* in the valve case 13.

In this EGR cooler, the valve shaft 13*a* is inserted into the through hole 34 and its tip end is supported by the bearing 27*a*. Also, the rear end portion is supported by the spacer 29*a*. Then, to the cutaway portions 22*a*, 23*a* of the valve shaft 13*a*, the core opening/closing valve 16*a* and the bypass opening/closing valve 16*b* are mounted through the screws 35. Rings 36 are set between them. Then, the valve driving body 15 is fixed to the side edge portion of the reinforcing body 19*d* trough a bracket 25*a* and the screws 35. And the first link 15*a* of the valve driving body 15 is connected to the rear end of the valve case 13 through the second link 15*b* so as to complete the EGR cooler.

In the EGR cooler completed as above, the exhaust gas 12 flows from the left-end side flange 25 into the header portion 31*a* in FIG. 5 and communicates through the second flow passage 4 side of the core 8. At this time, the bypass opening/closing valve 16*b* is in the closed state. The core opening/closing valve 16*a* is in the opened state. Also, the cooling water 10 flows in from the one pipe 26 and communicates through the first flow passage 3. And heat is exchanged between the cooling water 10 and the exhaust gas 12 so as to cool the exhaust gas 12, which is guided to the EGR. The EGR is connected to the flange portion 13*c* of the valve case 13 through the flange portion 19*a* of the reinforcing body 19*d*.

Next, if the temperature of the exhaust gas 12 is relatively low, the first link 15*a* of the valve driving body 15 shrinks and rotates the valve shaft 13*a* through the second link 15*b* by 90 degrees so as to bring the core opening/closing valve 16*a* into the closed state and the bypass opening/closing valve 16*b* into the opened state. And the exhaust gas 12 is guided to the EGR through the bypass duct portion 18. If the temperature of the exhaust gas 12 is in the middle, the core opening/closing valve 16*a* and the bypass opening/closing valve 16*b* can be brought into the semi-open state, respectively.

The invention claimed is:

1. An EGR cooler comprising:

a core having a flat first flow passage and a second flow passage alternately arranged side by side;

a casing fitted to an outer periphery of the core;

header portions for an exhaust gas arranged at both ends of the casing in a longitudinal direction coincident with flow or the exhaust gas;

a bypass duct formed between an inner surface of a bypass duct portion of the casing and a side of the core, said bypass duct portion of said casing being bent to have a cross section in an arc;

said bypass duct portion of said casing having a heat stress absorbing portion including ribs configured as at least one of inner ribs or outer ribs, the ribs being arranged side by side in the longitudinal direction and extending in a circumferential direction of the arc while being separated from each other in the longitudinal direction;

the first flow passage of the core accepting cooling water and the header portions directing the exhaust gas to and from the second flow passage; and a switch configured for switching and guiding the exhaust gas to either of the core or the bypass duct.

2. The EGR cooler according to claim 1, wherein one header portion of the header portions communicates with both the core and the bypass duct and is provided with one port; and another header portion of the header portions has a partition plate inside separating the core and the bypass duct from each other, and two ports are formed with the partition plate separating and defining the two ports.

3. The EGR cooler according to claim 1, further comprising a partition plate provided at a boundary between said core and said bypass duct, and the ribs and ends of the ribs are formed on the bypass duct portion of the casing so as not to cross an edge portion of the partition plate.

4. The EGR cooler according to claim 2, further comprising:

an integrally formed tubular valve case formed by deep-drawing of a thin metal plate by a press machine, said valve case having a valve case opening fixed to an opening of said another header portion, an intra-valve partition plate dividing the valve case into two parts fixed inside said valve case, a rear-end edge portion of the intra-valve partition plate brazed to a tip end edge portion of the partition plate separating the core and the bypass duct, a pair of slits conforming to a plate thickness of said intra-valve partition plate are provided at a rear end of said valve case, edges of the intra-valve partition plate being inserted into the slits, and support projection portions are formed on faces of the edges of the intra-valve partition plate and arranged supported on inner edges of said slits, and a valve shaft inserted into the valve case, and a core opening/closing valve and a bypass opening/closing valve are fixed to the valve shaft and provided on both sides of said intra-valve partition plate so as to cross perpendicularly each other so that the cooling water is guided to the first flow passage of said core and the high-temperature exhaust gas is made to selectively communicate with the second flow passage side and said bypass duct portion side of said core through rotation of said valve shaft.

5. The EGR cooler according to claim 4, wherein the valve case has an outer periphery formed a substantially rectangular tubular section comprising four sides which each have a flat center part, the four sides forming the valve case opening in an oval configuration formed by projecting curved faces from the four sides, the valve case opening conforming to and fixed to the opening of the another header portion, and said valve shaft is inserted into a hole in one side of said four sides of said substantially rectangular tubular section of the valve case.

6. The EGR cooler according to claim 5, further comprising:

a reinforcing body made of a press formed body of a metal plate thicker than a plate thickness of said valve case, the reinforcing body having a reinforcing body flange portion defining a valve case accepting opening within which the valve case is disposed, the valve case having a valve case flange portion defining a valve case outer opening of the valve case and engaged with the reinforcing body flange portion, the reinforcing body having a side edge portion extended integrally from a peripheral edge of the reinforcing body flange portion and brazed to an outer face of an end portion of said casing, and a valve driving device mounted to said side edge portion of the reinforcing body and connected to said valve shaft.

7. The EGR cooler according to any of claims 1, 2, 4 or 5, wherein;

said core includes a core body formed by a strip-shaped metal plate turned up and bent in a fanfold manner with turned-up end edges alternately formed at one end and another end of a rectangular flat face portion and the flat first flow passage and the second flow passage are provided alternately in a thickness direction of the metal plate, the first flow passage of the core body is defined in part by comb members disposed at opposing end positions of said turned-up end edges, and a fin is set within said second flow passage, the core body is fitted within the casing so as to block the adjacent turned-up end edges, the first flow passage being further defined by a casing side of said casing having a pair of ports on an outer face of said casing side for accepting cooling water, while the exhaust gas is guided from a first end of said casing to a second end through the second flow passage and the bypass duct.

* * * * *